US007862313B2

(12) United States Patent
Hwang et al.

(10) Patent No.: US 7,862,313 B2
(45) Date of Patent: Jan. 4, 2011

(54) COMPRESSOR AND OIL SEPARATING DEVICE THEREFOR

(75) Inventors: Seon-Woong Hwang, Seoul (KR); Myung-Kyun Kiem, Seoul (KR); Byung-Kil Yoo, Seoul (KR); Cheol-Hwan Kim, Seoul (KR); Chul-Su Jung, Seoul (KR); Dong-Koo Shin, Seoul (KR); Se-Heon Choi, Seoul (KR); Yang-Hee Cho, Seoul (KR); Byeong-Chul Lee, Seoul (KR); Hyo-Keun Park, Seoul (KR); Sung-Yong Ahn, Seoul (KR); Ki-Tae Jang, Seoul (KR)

(73) Assignee: LG Electronics Inc., Seol (KR)

( * ) Notice: Subject to any disclaimer, the term of this patent is extended or adjusted under 35 U.S.C. 154(b) by 258 days.

(21) Appl. No.: 11/933,534

(22) Filed: Nov. 1, 2007

(65) Prior Publication Data

US 2008/0170957 A1 Jul. 17, 2008

(30) Foreign Application Priority Data

Jan. 15, 2007 (KR) ..... 10-2007-0004553
Jan. 15, 2007 (KR) ..... 10-2007-0004554

(51) Int. Cl.
*F04C 18/00* (2006.01)

(52) U.S. Cl. ..... 418/55.6; 418/55.1; 418/DIG. 1; 418/97; 62/470

(58) Field of Classification Search ..... 418/55.1, 418/55.6, DIG. 1, 97, 270; 55/394; 62/470; 210/416.5

See application file for complete search history.

(56) References Cited

U.S. PATENT DOCUMENTS 3,922,114 A 11/1975 Hamilton et al. ..... 417/366
4,343,599 A * 8/1982 Kousokabe ..... 418/55.6
4,755,114 A 7/1988 Shibayashi et al. ..... 418/55.6
4,889,471 A 12/1989 Izunaga et al. ..... 418/55.6

(Continued)

FOREIGN PATENT DOCUMENTS

JP 62-135693 6/1987

(Continued)

OTHER PUBLICATIONS

Notification of International Search Report dated Dec. 28, 2007.

(Continued)

*Primary Examiner*—Thomas E Denion
*Assistant Examiner*—Mary A Davis
(74) *Attorney, Agent, or Firm*—KED & Associates, LLP

(57) ABSTRACT

A compressor and an oil separating device therefor are provided which are capable of always maintaining a predetermined amount of oil in the compressor without additionally providing an oil separating device along a refrigerating cycle system. This results in the refrigerating cycle system having simplified piping and the refrigerant discharged from the compressor having a constant pressure, thereby preventing a function of the refrigerating cycle system from being reduced. The compressor includes a casing, a compression device having a compression chamber disposed within the casing and configured to receive, compress, and output a refrigerant, and an oil separating device disposed within the casing. The oil separating device includes a separation chamber configured to circulate the refrigerant to separate oil therefrom, a guide member configured to direct the refrigerant discharged from the compression device, and a circulation member configured to receive the refrigerant from the guide member and direct the refrigerant into the separation chamber in a direction of circulation.

18 Claims, 11 Drawing Sheets

U.S. PATENT DOCUMENTS

| | | | | |
|---|---|---|---|---|
| 4,898,520 | A | 2/1990 | Nieter et al. | 418/151 |
| 5,174,740 | A * | 12/1992 | Jang | 418/55.6 |
| 5,219,281 | A | 6/1993 | Caillat et al. | 418/55.6 |
| 5,263,822 | A * | 11/1993 | Fujio | 418/55.6 |
| 5,310,326 | A | 5/1994 | Gui et al. | 418/76 |
| 5,370,513 | A | 12/1994 | Fain | 418/99 |
| 5,591,018 | A * | 1/1997 | Takeuchi et al. | 417/366 |
| 5,772,411 | A | 6/1998 | Crum et al. | 418/55.1 |
| 5,775,120 | A | 7/1998 | Inazuka et al. | 62/259 |
| 5,775,123 | A | 7/1998 | Wakayama et al. | 62/407 |
| 5,947,373 | A | 9/1999 | Saito et al. | 237/2 |
| 6,042,346 | A | 3/2000 | Doi | 417/371 |
| 6,106,254 | A | 8/2000 | Hirooka et al. | 418/55.6 |
| 6,123,527 | A | 9/2000 | Kawada et al. | 418/151 |
| 6,149,413 | A | 11/2000 | Lifson | 418/99 |
| 6,182,460 | B1 | 2/2001 | Hernandez | 62/262 |
| 6,309,198 | B1 * | 10/2001 | Zamudio et al. | 418/55.6 |
| 6,386,840 | B1 | 5/2002 | Williams et al. | 418/55.6 |
| 6,412,298 | B2 | 7/2002 | Kang et al. | 62/262 |
| 6,422,843 | B1 | 7/2002 | Sun et al. | 418/99 |
| 6,527,085 | B1 | 3/2003 | Paczuski | 184/6.18 |
| 6,554,595 | B2 * | 4/2003 | Hida et al. | 418/DIG. 1 |
| 6,588,228 | B2 | 7/2003 | Choi | 62/426 |
| 6,599,100 | B2 | 7/2003 | Abe et al. | 418/55.6 |
| 6,746,215 | B2 * | 6/2004 | Tani et al. | 418/55.6 |
| 6,772,601 | B1 | 8/2004 | Davis et al. | 62/187 |
| 6,860,729 | B2 | 3/2005 | Sowa et al. | 418/151 |
| 6,868,681 | B2 | 3/2005 | Woo et al. | 62/175 |
| 6,925,832 | B2 * | 8/2005 | Kitaura et al. | 418/55.1 |
| 6,932,586 | B2 | 8/2005 | Furusho et al. | 418/55.6 |
| 6,955,064 | B2 | 10/2005 | Lee et al. | 62/453 |
| 6,962,058 | B2 | 11/2005 | Kim et al. | 62/175 |
| 7,032,404 | B2 | 4/2006 | Kim et al. | 62/262 |
| 7,036,331 | B2 | 5/2006 | Kim | 62/62 |
| 7,055,338 | B2 | 6/2006 | Ergarae et al. | 62/228.1 |
| 7,082,776 | B2 | 8/2006 | Shin | 62/186 |
| 7,112,046 | B2 | 9/2006 | Kammhoff et al. | 418/55.1 |
| 7,114,345 | B2 | 10/2006 | Kim et al. | 62/296 |
| 7,121,106 | B2 | 10/2006 | Jung et al. | 62/324.6 |
| 7,311,501 | B2 | 12/2007 | Wehrenberg et al. | 418/55.6 |
| 7,384,250 | B2 | 6/2008 | Shin et al. | 418/55.6 |
| 2003/0063986 | A1 | 4/2003 | Ginies et al. | 417/366 |
| 2005/0232800 | A1 | 10/2005 | Kammhoff et al. | 418/55.6 |
| 2005/0265878 | A1 * | 12/2005 | Ishida | 418/55.1 |
| 2006/0057012 | A1 | 3/2006 | Park et al. | 418/55.6 |
| 2006/0065012 | A1 * | 3/2006 | Kudo | 62/469 |
| 2006/0216182 | A1 * | 9/2006 | Kohsokabe et al. | 418/55.6 |
| 2007/0071627 | A1 | 3/2007 | Lee et al. | 418/55.6 |

FOREIGN PATENT DOCUMENTS

| | | | |
|---|---|---|---|
| JP | 62-298679 | | 12/1987 |
| JP | 63-192985 | | 8/1988 |
| JP | 02-146285 | | 6/1990 |
| JP | 03-160178 | | 7/1991 |
| JP | 05-149274 | | 6/1993 |
| JP | 06-002680 | | 1/1994 |
| JP | 06002680 | A * | 1/1994 |
| JP | 06-235387 | | 8/1994 |
| JP | 07-054788 | | 2/1995 |
| JP | 07054788 | A * | 2/1995 |
| JP | 07-197893 | | 8/1995 |
| JP | 07-332265 | | 12/1995 |
| JP | 08-151990 | | 6/1996 |
| JP | 2001-207980 | | 8/2001 |
| JP | 2001-329978 | | 11/2001 |
| JP | 2002-138961 | | 5/2002 |
| JP | 2003-003974 | | 1/2003 |
| JP | 2003-293955 | | 10/2003 |
| JP | 2004-100662 | | 4/2004 |
| JP | 2005-201145 | | 7/2005 |
| JP | 2005201145 | A * | 7/2005 |
| KR | 10-2000-0026721 | | 5/2000 |
| KR | 1020010035692 | | 5/2001 |
| KR | 10-2001-0057497 | | 7/2001 |
| KR | 10-2001-0059281 | | 7/2001 |
| KR | 10-2005-0062998 | | 6/2005 |
| KR | 10-2005-0073532 | | 7/2005 |

OTHER PUBLICATIONS

Written Opinion of the International Search Report dated Dec. 28, 2007.

International Search Report dated Dec. 28, 2007.

U.S. Office Action dated Jan. 22, 2010 for U.S. Appl. No. 11/856,794.

U.S. Office Action dated Sep. 16, 2009 for U.S. Appl. No. 12/048,337.

U.S. Office Action dated Nov. 13, 2009 for U.S. Appl. No. 11/930,515.

U.S. Office Action dated Jun. 16, 2009 for U.S. Appl. No. 11/856,794.

* cited by examiner

COMPRESSOR AND OIL SEPARATING DEVICE THEREFOR

BACKGROUND

The present application claims priority to Korean Applications No. 10-2007-0004553 and No. 10-2007-0004554 filed in Korea Jan. 15, 2007, which are hereby incorporated by reference in their entirety.

FIELD

A compressor and an oil separator therefore are disclosed herein.

BACKGROUND

Compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
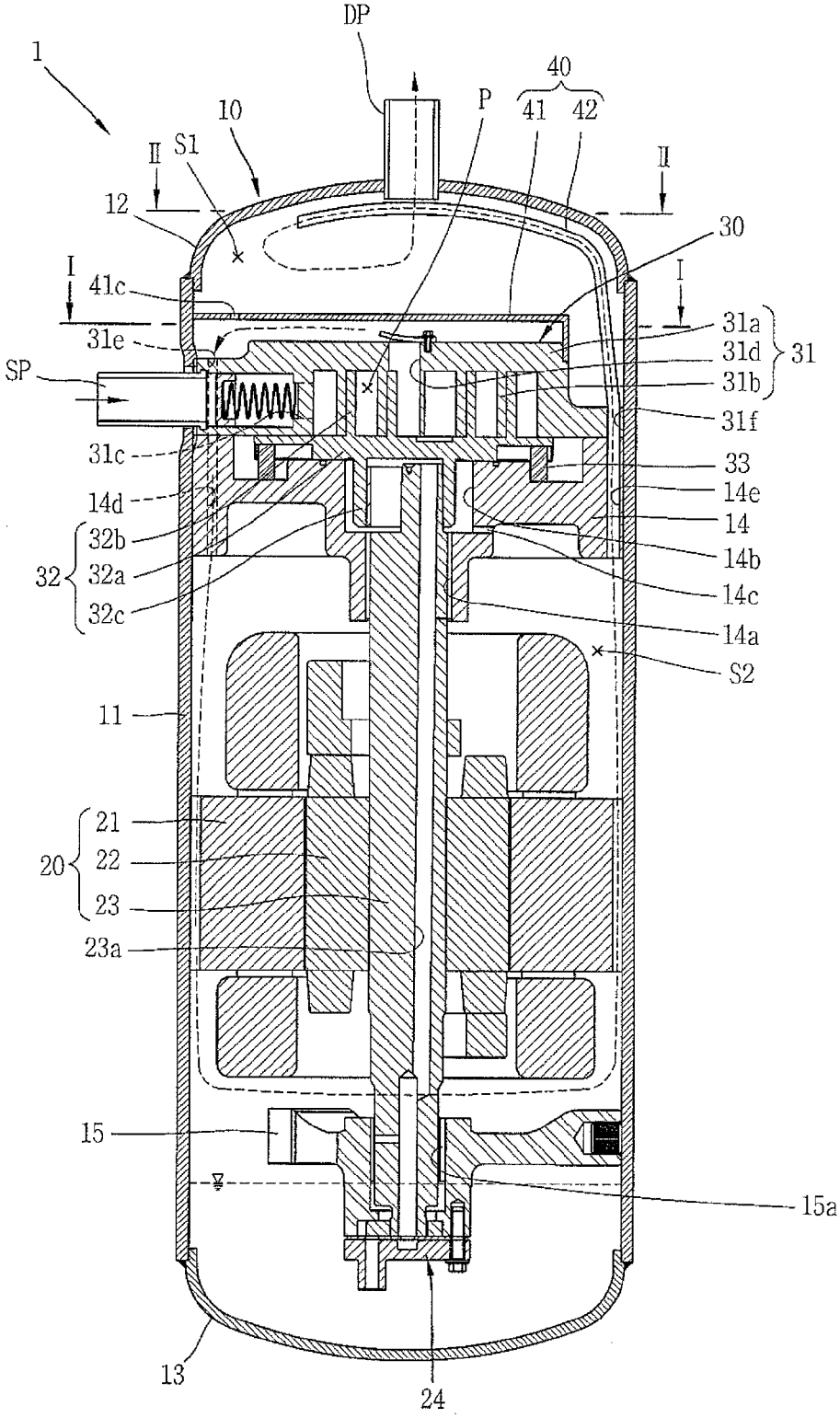
FIG. 1 is a longitudinal sectional view of a scroll compressor having an oil separating device according to a embodiment.

Generally, a compressor is a device for converting mechanical energy into compression energy to compressor a fluid. Compressors are divided into several types including a reciprocating compressor, a rotary compressor, a vane compressor, and a scroll compressor according to the method of compressing the fluid.

A scroll compressor may include a driving motor that generates a driving force in a hermetic casing, and a compression device that compresses a refrigerant by receiving the driving force generated by the driving motor. The compression device may include an orbiting scroll coupled to a driving shaft of the driving motor that performs an orbit motion with respect to a fixed scroll, thus forming a plurality of compression chambers. As the compression chambers move towards a center, a refrigerant is consecutively compressed and then discharged.

When the driving motor rotates, oil contained in an inner space of the casing may be sucked along the driving shaft to lubricate the compression device and cool the driving motor. However, in the related art scroll compressor, oil mixed with a refrigerant discharged from the compression device is discharged into a refrigerating cycle system. Since the compressor is not provided with an oil separating function, if an oil separating device for oil collection is not additionally installed in the compressor, a reliability of the compressor is reduced due to oil deficiency. When an oil separating device is provided along the refrigerating cycle system, a pipe for connecting the oil separating device and the compressor is required. As a result, fabrication cost is increased, and the refrigerating cycle system has a lowered function due to a lower pressure of refrigerant discharged from the compressor having passed through the oil separating device.

Hereinafter, a scroll compressor according to embodiments will be explained in detail with reference to the attached drawings. An oil separating device according embodiments is disclosed in detail implemented in a scroll compressor. However, the oil separating device according embodiments may be implemented in other types of compressors. Further, the oil separating device according to embodiments may be implemented in a high side scroll compressor or a low side scroll compressor.

FIGS. 1 to 5 are views showing a high pressure type scroll compressor having an oil separating device according an embodiment. As shown in FIG. 1-5, a scroll compressor 1 according to an embodiment may include a casing 10 containing a predetermined amount of oil and hermetically maintained at a discharge pressure, a driving motor 20 disposed within the casing 10 that generates a rotational force, a compression device 30 disposed within the casing 10 that compresses a refrigerant by receiving the rotational force generated by the driving motor 20, and an oil separating device or unit 40 disposed at an outlet of the compression device 30 that separates a refrigerant and oil from each other. The casing 10 may include a body 11 having a cylindrical shape and having the driving motor 20 and the compression device 30 fixed at upper and lower portions of an inner circumferential surface thereof and an upper cap 12 and a lower cap 13 that seal upper and lower ends of the body 11.

A refrigerant suction pipe SP may be coupled to an upper side of the body 11 so as to be directly coupled to an inlet 31*c* of a fixed scroll 31. A refrigerant discharge pipe DP may be connected to an upper center of the upper cap 12 so as to be connected to an upper space S1 of the casing 10. A main frame 14 and a sub frame 15 each having axial holes 14*a* and 15*b* that support the driving shaft 23 of the driving motor 20 may be fixed at inner upper and lower sides of the body 11.

The axial hole 14*a* may be penetratingly formed at a center of the main frame 14, and an oil pocket 14*b* that collects oil sucked along the driving shaft 23 of the driving motor may be disposed at an upper end of the axial hole 14*a*. An oil collecting hole 14*c* that supplies oil stored in the oil pocket 14*b* to the casing 10 may be penetratingly formed on an outer circumferential surface of the oil pocket 14*b*.

A first connection passage 14*d* through which a refrigerant and oil may be guided to a lower space S2 of the casing 10 by a guiding member 41 of the oil separating device 40 may be formed at one side at an outer circumferential surface of the main frame 14. A second connection passage 14*e* through which the refrigerant moved to the lower space S2 and oil not separated from the refrigerant may be moved to an upper space S1 may be formed at another side at the outer circumferential surface of the main frame 14 that is not received by the guiding member 41. An oil collecting passage (not shown)

through which oil separated from a refrigerant in the upper space S1 may be moved to the lower space S2 may be formed at one side at the outer circumferential surface of the main frame 14.

The outer circumferential surface of the main frame 14 that is not covered by the guiding member 41 need not be sealed by the casing 10. Also, an oil collecting hole need not be additionally formed in the main frame 14.

The oil separating device 40 may include separating member 42 in the form a pipe or tube that separates the refrigerant and oil coupled to one side of the outer circumferential surface of the main frame 14 not covered by the guiding member 41. The guiding member 41 may be disposed to cover an upper surface of a plate portion 31*a* of a fixed scroll 31 so as to hermetically cover a discharge port 31*d* of the fixed scroll 31 fixed to the casing 10 to form the compression device 30 together with an orbiting scroll 32.

Figure 2:
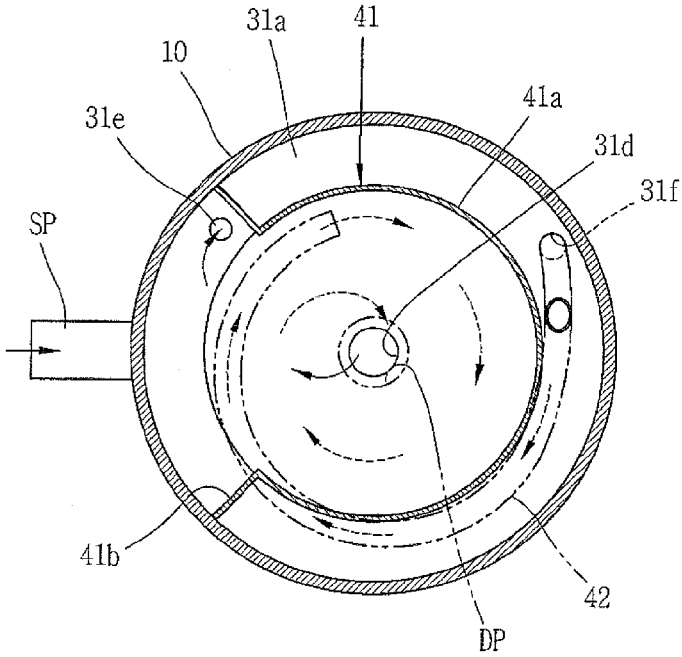
FIG. 2 is a cross-sectional view taken along line 'I-I' of FIG. 1.

As shown in FIGS. 1 and 2, the guiding member 41 may have a fan shape so as to partially cover the casing 10 in a horizontal direction. An arc portion 41*a* may be adhered to an outer circumferential surface of the plate portion 31*a* of the fixed scroll 31, and a straight portion 41*b* opposite to the arc portion 41*a* may be adhered to an inner circumferential surface of the casing 10. The guiding member 41 may be hermetically coupled to an outer circumferential surface or an upper surface of the plate portion 31*a* of the fixed scroll 31 so that an inner space of the guiding member 41 may be sealed.

An oil collecting through hole 41*c* that collects oil separated from a refrigerant at the upper space S1 of the casing 10 to the inner space of the guiding member 41 may be formed in an upper surface of the guiding member 41. The oil collecting through hole 41*c* may be formed to have a size small enough to be blocked by oil, thereby preventing refrigerant leakage.

Figure 3:
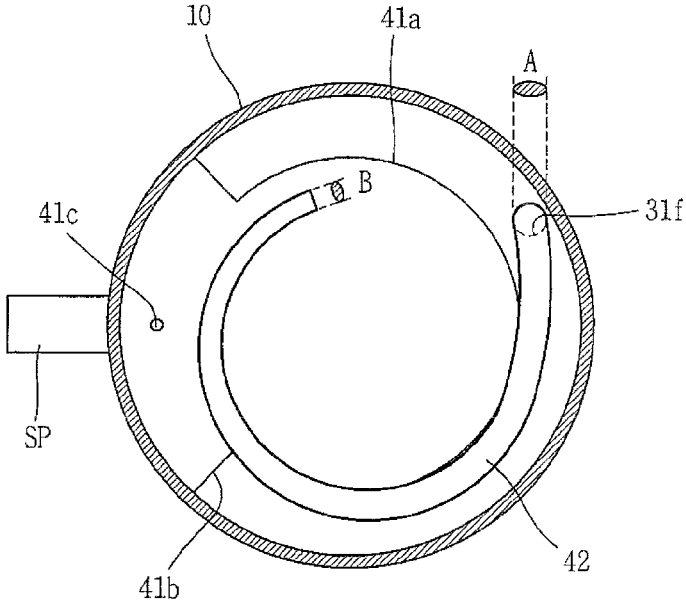
FIGS. 3 and 4 are cross-sectional views taken along line 'II-II' of FIG. 1.
Figure 4:
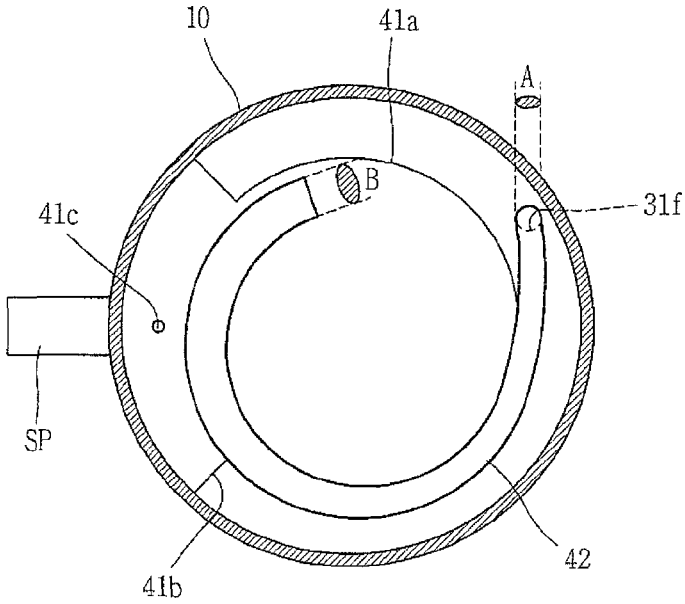

As shown in FIG. 2, the separating member 42 may have a pipe shape with a constant diameter. As shown in FIG. 3, the separating member 42 may have a pipe shape with a cross-sectional area A of an outlet being larger than a cross-sectional area B of an inlet so as to increase an orbiting speed of refrigerant and oil. As shown in FIG. 4, the separating member 42 may have a pipe shape with a cross-sectional area A of the outlet being smaller than the cross-sectional area B of the inlet so as to decrease an orbiting speed of refrigerant and oil.

The outlet of the separating member 42 may have a planar cross-sectional surface or an inclined cross-sectional surface. When the outlet of the separating member 42 has an inclined cross-sectional surface, the inclined cross-sectional surface may be disposed to face an inner circumferential surface of the casing 10 so as to smoothly guide refrigerant and oil to the inner circumferential surface of the casing 10.

The separating member 42 may be disposed along a plane and may be curved or bent on the plane so that refrigerant is directed to orbit in a clockwise direction or in a counterclockwise direction along the inner circumferential surface of the casing 10. The separating member 42 may be curved or bent on a second dimensional surface or plane or on a third dimensional surface or plane.

A synchronous reluctance motor having a plurality of magnetic flux barriers at a rotor 22 may be used as the driving motor 20, as shown in FIG. 1. However, an induction motor may be used also.

As shown in FIGS. 1 to 5, the fixed scroll 31 may be formed so that a fixing wrap 31*b* forming a pair of compression chambers P may be formed at a lower surface of the plate portion 31*a* with an involute shape. A suction port 31*c* to which a refrigerant suction pipe SP may be directly connected may be formed at a side surface of the plate portion 31*a*. Also, a discharge port 31*d* that discharges a compressed refrigerant to the upper space S1 of the casing 10 may be formed at a center of an upper surface of the plate portion 31*a*.

Figure 5:
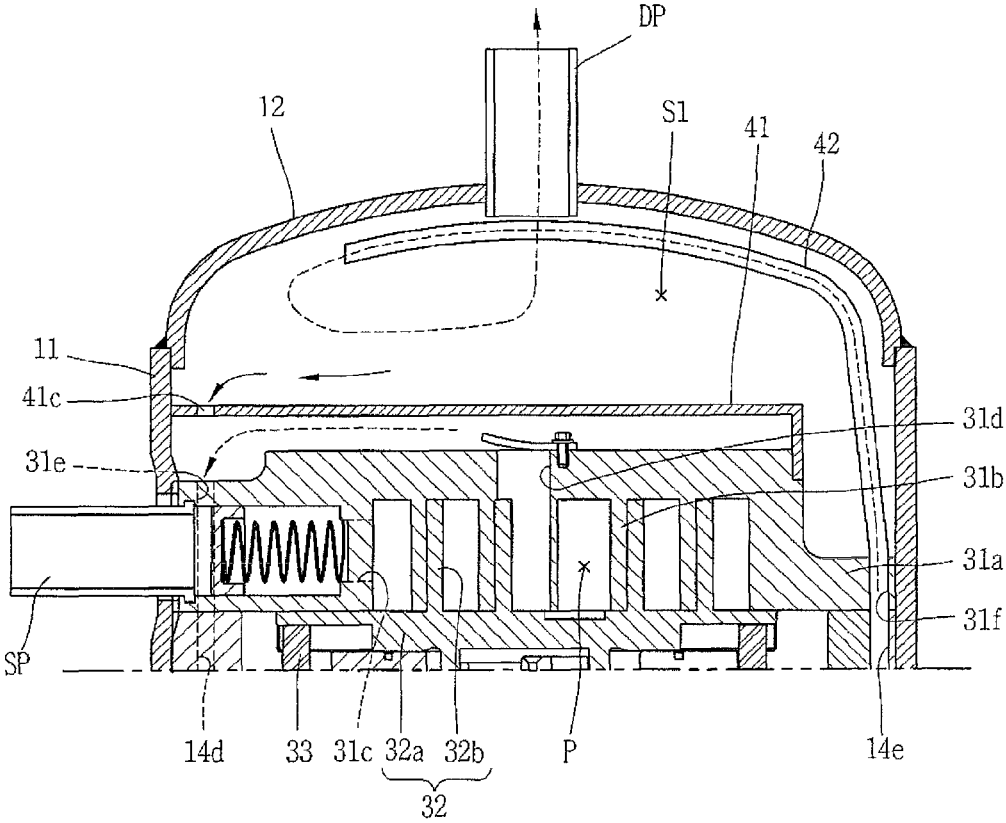
FIG. 5 is a longitudinal sectional view showing an upper part of the scroll compressor of FIG. 1.

As shown in FIG. 5, a first connection hole 31*e* that guides discharged refrigerant and oil to the lower space S2 of the casing 10 may be formed in the plate portion 31*a* of the fixed scroll 31 that is covered by the guiding member 41. The first connection hole 31*e* may be connected to the first connection passage 14*d* of the main frame 14. A second connection hole 31*f* that guides a refrigerant having circulated through the lower space S2 of the casing 10 and oil not separated from the refrigerant to the upper space S1 is formed at the plate portion 31*a* of the fixed scroll 31 which is not covered by the guiding member 41. The second connection hole 31*f* may be connected to the second connection passage 14*e* of the main frame 14. The separating member 42 may be insertion-coupled to an outlet of the second connection hole 31*f*. A stepped surface that couples to the guiding member 41 may be formed on an outer circumferential surface of the plate portion 31*a* of the fixed scroll 31.

As shown in FIG. 1, the orbiting scroll 32 may be formed so that an orbiting wrap 32*b* forming a pair of compression chambers P together with the fixing wrap 31*b* of the fixed scroll 31 may be formed in an upper surface of a plate portion 32*a* with an involute shape. A boss portion 32*c*, which may be coupled to the driving shaft 23 and which receives a driving force generated by the driving motor 20, may be formed at a center of a lower surface of the plate portion 32*a*. Further, in the drawings, reference numeral 21 denotes a stator, 23*a* denotes an oil passage, 24 denotes an oil pump, and 33 denotes an Oldham's ring.

Operation of a scroll compressor according to embodiments disclosed herein will be described herein below.

When power is supplied to the driving motor 20, the driving shaft 23 rotates together with the rotor 22 to transmit a rotational force to the orbiting scroll 32. Then, the orbiting scroll 32 performs an orbiting motion on an upper surface of the main frame 14 due to the Oldham's ring 33. Accordingly, a pair of compression chambers P that consecutively move are formed between the fixing wrap 31*b* of the fixed scroll 31 and the orbiting wrap 32*b* of the orbiting scroll 32. As the orbiting scroll 32 continuously performs the orbiting motion, the compression chambers P move towards the center to a decreased volume, thereby compressing a sucked refrigerant.

An oil pump 24 disposed at a lower end of the driving shaft 23 pumps oil contained in the casing 10. The oil is sucked to an upper end of the driving shaft 23 through the oil passage 23*a* of the driving shaft 23. Some of the oil is supplied to the axial holes 14*a* and 15*a* of the main frame 14 and the sub frame 15, and some is dispersed from the upper end of the driving shaft 23 thus to be supplied to the compression chambers P via the oil pocket 14*b* of the main frame 14.

As shown in FIG. 5, the refrigerant and oil introduced into the compression chambers P move to the center of the compression chambers P, and are discharged through the discharge port 31*d*. Then, the refrigerant and oil guided by the guiding member 41 move to the lower space S2 of the casing 10 through the first connection hole 31*e* of the fixed scroll 31 and the first connection passage 14*d* of the main frame 14. Then, the refrigerant and oil circulate through the lower space S2 thus to cool the driving motor 20, and are discharged to the upper space S1 of the casing 10 through the second connection passage 14*e* of the main frame 14, the second connection hole 31*f* of the fixed scroll 31, and the separating member 42 coupled to the second connection hole 31*f*. Since the separating member 42 may be curved or bent along the inner circumferential surface of the casing 10, refrigerant and oil discharged from the separating member 42 performs an orbiting motion or circulates along the inner circumferential surface of the casing 10. In this way, the refrigerant and oil are separated from each other by a centrifugal force. The refrigerant moves to the refrigerating cycle system through the refrigerant discharge pipe DP, whereas the oil moves to the lower space S2 of the casing 10 via the oil collecting through hole 41*c* in the guiding member 41 or an oil collecting passage (not shown) of the main frame 14 to be collected.

Since the oil separating device is provided in the compressor, a predetermined amount of oil is always maintained in the compressor without additionally installing an oil separating device along or in the refrigerating cycle system. Accordingly, the refrigerating cycle system has simplified piping and the refrigerant has constant pressure, thereby preventing a function of the refrigerating cycle system from being reduced.

Figure 6:
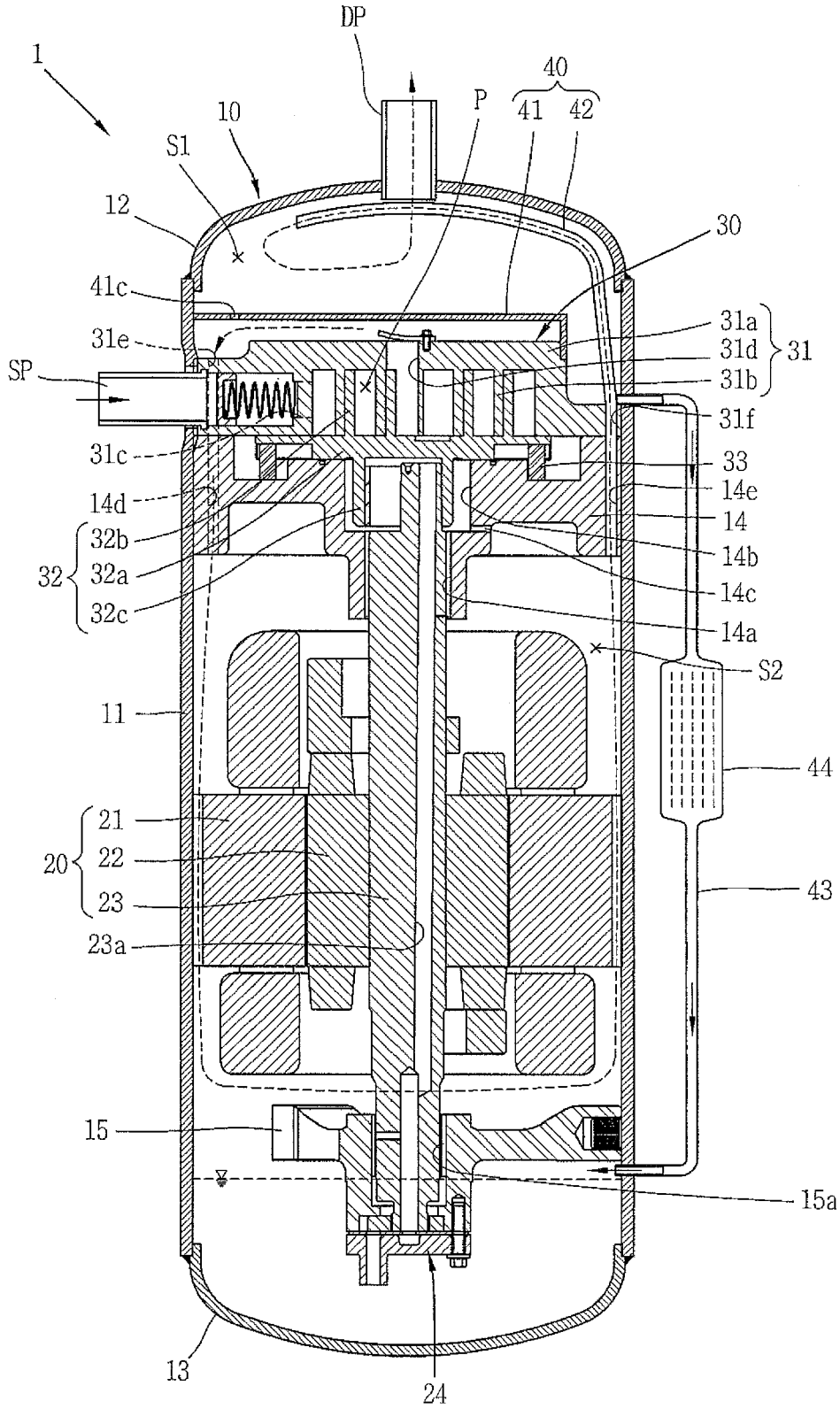
FIG. 6 is a longitudinal sectional view of a scroll compressor having an oil separating device according to another embodiment.

The scroll compressor may be constructed so that collected oil may be cooled outside the casing to lower a temperature of the oil. That is, shown in FIG. 6, an oil collecting pipe 43 connected to the lower space S2 from the upper space S1 of the casing 10 may be disposed outside the casing 10. An inlet of the oil collecting pipe 43 may be connected to an upper side of the plate portion 31*a* of the fixed scroll 31, and an outlet of the oil collecting pipe 43 may be connected to a lower side of the sub frame 15. The outlet of the oil collecting pipe 43 may be connected between a lower side of the driving motor 20 and an upper side of the sub frame 15, or between a lower side of the main frame 14 and an upper side of the driving motor 20. A capillary tube or a capillary path 44 that lowers a temperature of collected oil may be disposed at a middle portion of the oil collecting pipe 43 outside the casing 10.

An oil separating device according to another embodiment will be explained herein below. Like reference numerals have been used to designate like elements, and repetitive disclosure has been omitted.

Figure 7:
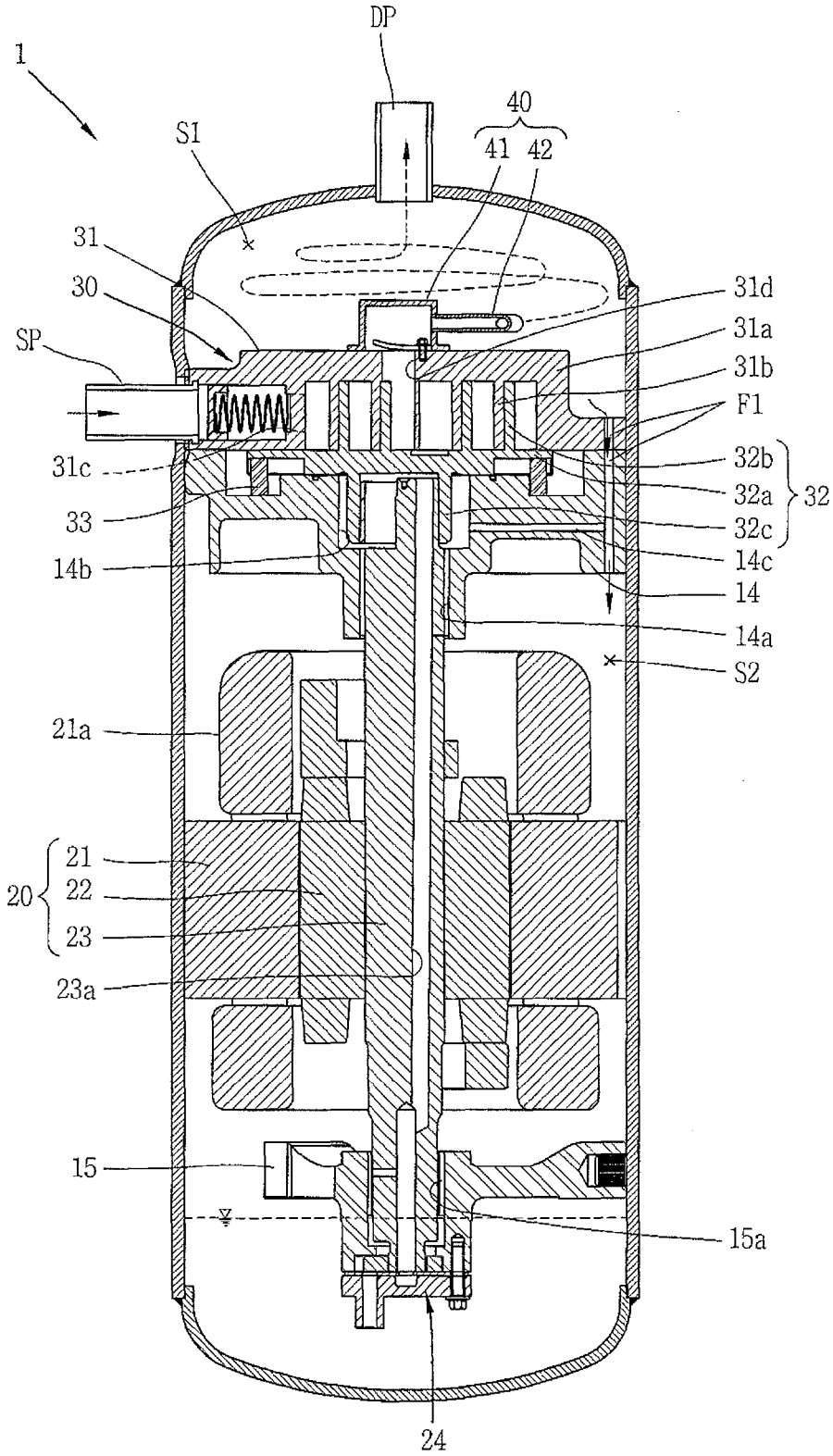
FIGS. 7 and 8 are longitudinal sectional views of a scroll compressor having an oil separating device according to another embodiment.
Figure 8:
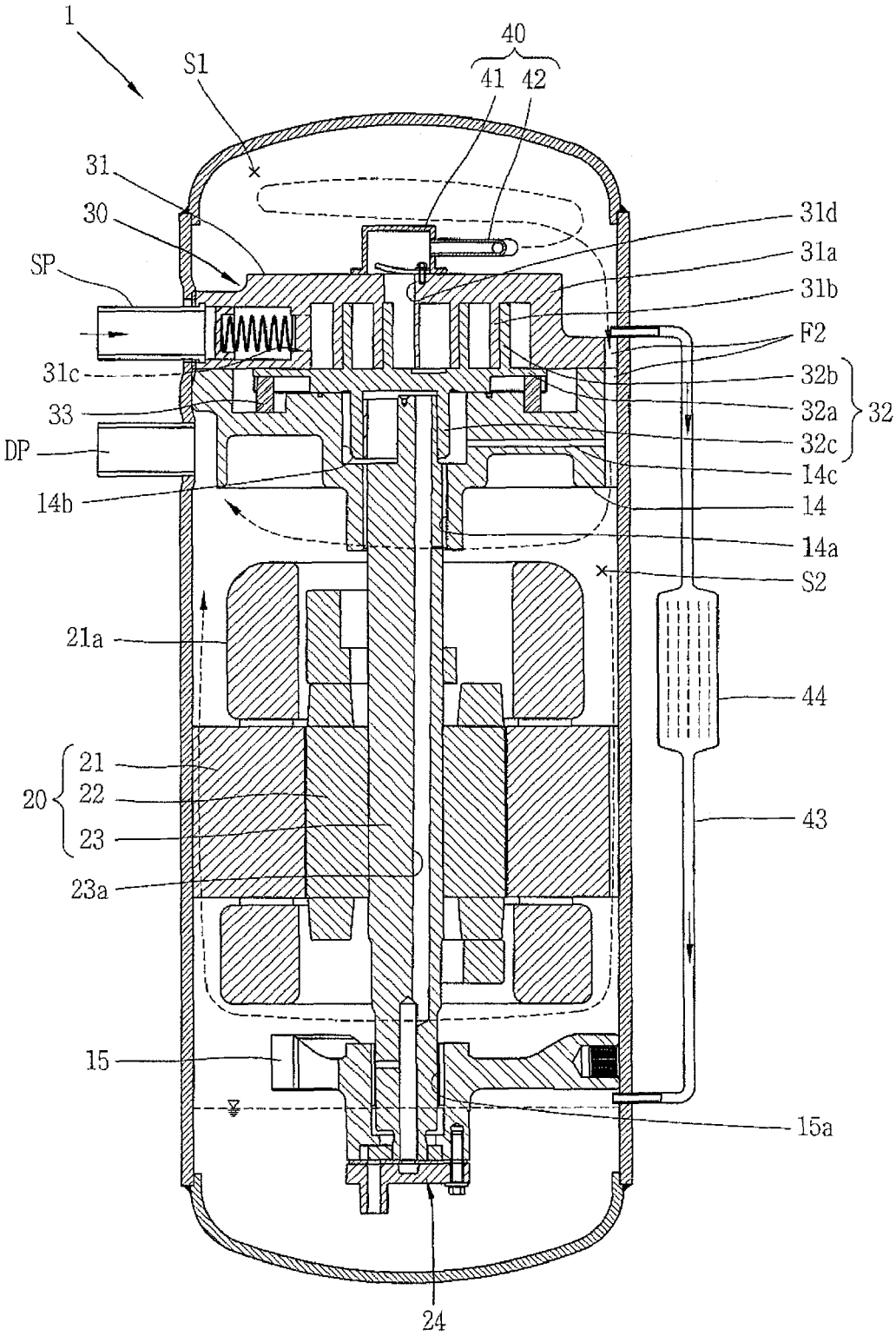

In the aforementioned embodiment, refrigerant discharged from the compression chambers is guided to the driving motor by the guiding member. However, in another embodiment, refrigerant discharged from the compression chamber is received in a guiding or receiving member having a cup shape, and then is guided to the upper space of the casing via a separating member in a pipe shape directly connected to the guiding or receiving member. As shown in FIGS. 7 and 8, the guiding or receiving member 41 that receives refrigerant discharged from the compression chambers may be formed at the plate portion 31*a* of the fixed scroll 31 by covering the discharge port 31*d*. The separating member 42, which discharges refrigerant discharged from the compression chambers P to the upper space of the casing, may be formed at the receiving member 41.

As shown in FIG. 7, when the refrigerant discharge pipe DP communicates with the upper space S1 having the oil separating device 40, an oil collecting passage F1 may be formed in the fixed scroll 31 and the main frame 14 so that oil separated from refrigerant by the oil separating device 40 may move to the lower space S2 of the casing 10. Further, an oil collecting pipe (not shown) may be installed to communicate with the oil collecting passage F1. As shown in FIG. 8, when the refrigerant discharge pipe DP communicates with the lower space S2, refrigerant and oil separated from each other by the oil separating device 40 may be mixed with each other while moving to the lower space S2. Accordingly, a refrigerant circulating passage F2 may be relatively widely formed on outer circumferential surfaces of the fixed scroll 31 and the main frame 14. Also, the oil collecting pipe 43 having the capillary tube or the capillary path 44 may be connected to outside of the casing 10 so that separated oil may move to the lower space S2 of the casing 10.

Figure 9:
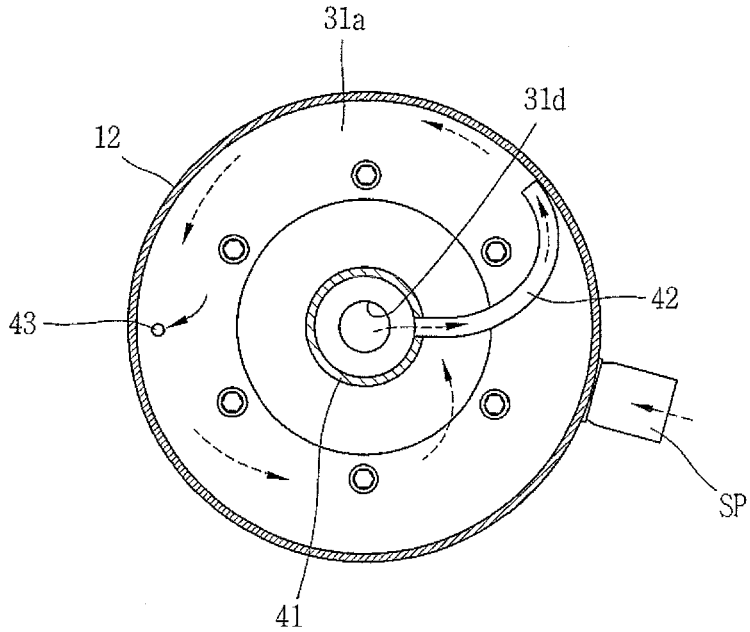
FIGS. 9 and 10 are planar views each showing a shape of the oil separating device of FIG. 7 and FIG. 8, respectively.
Figure 10:
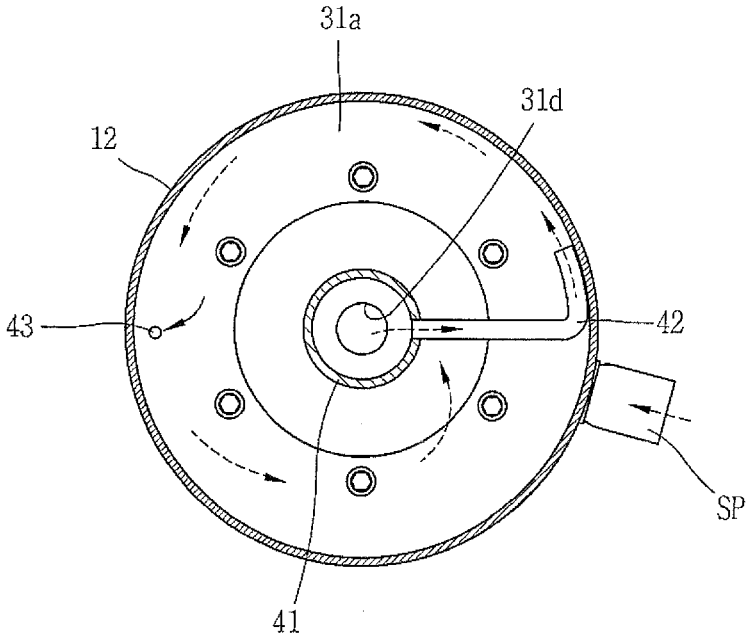

The separating member may be formed to have a similar shape as those of FIGS. 2 to 4. As aforementioned, the separating member may be curved or bent so that oil may be separated from refrigerant by centrifugal force. The separating member 42 may be curved on the plane, as shown in FIG. 9, or may be bent, as shown in FIG. 10, so that refrigerant orbits or circulates in a clockwise direction or in a counterclockwise direction along the inner circumferential surface of the casing 10. Further, the separating member 42 may be curved or bent on a second dimensional surface or plane, or on a third dimensional surface or plane.

Referring to FIGS. 7 and 8, the oil separating device 40 may include the cup-shaped guiding or receiving member 41 that receives the discharge port 31*d* of the fixed scroll 31, and the pipe-shaped separating member 42 and connected to the guiding or receiving member 41. The separating member 42 may be directly connected to the discharge port 31*d* of the fixed scroll 31. Herein, the separating member 42 may be formed so that an inlet and an outlet thereof may have the same diameter. The separating member 42 may be also formed so as to have a wide inlet and a narrow outlet and a backflow preventing valve (not shown) may be installed at the discharge port 31*d* of the fixed scroll 31.

Figure 11:
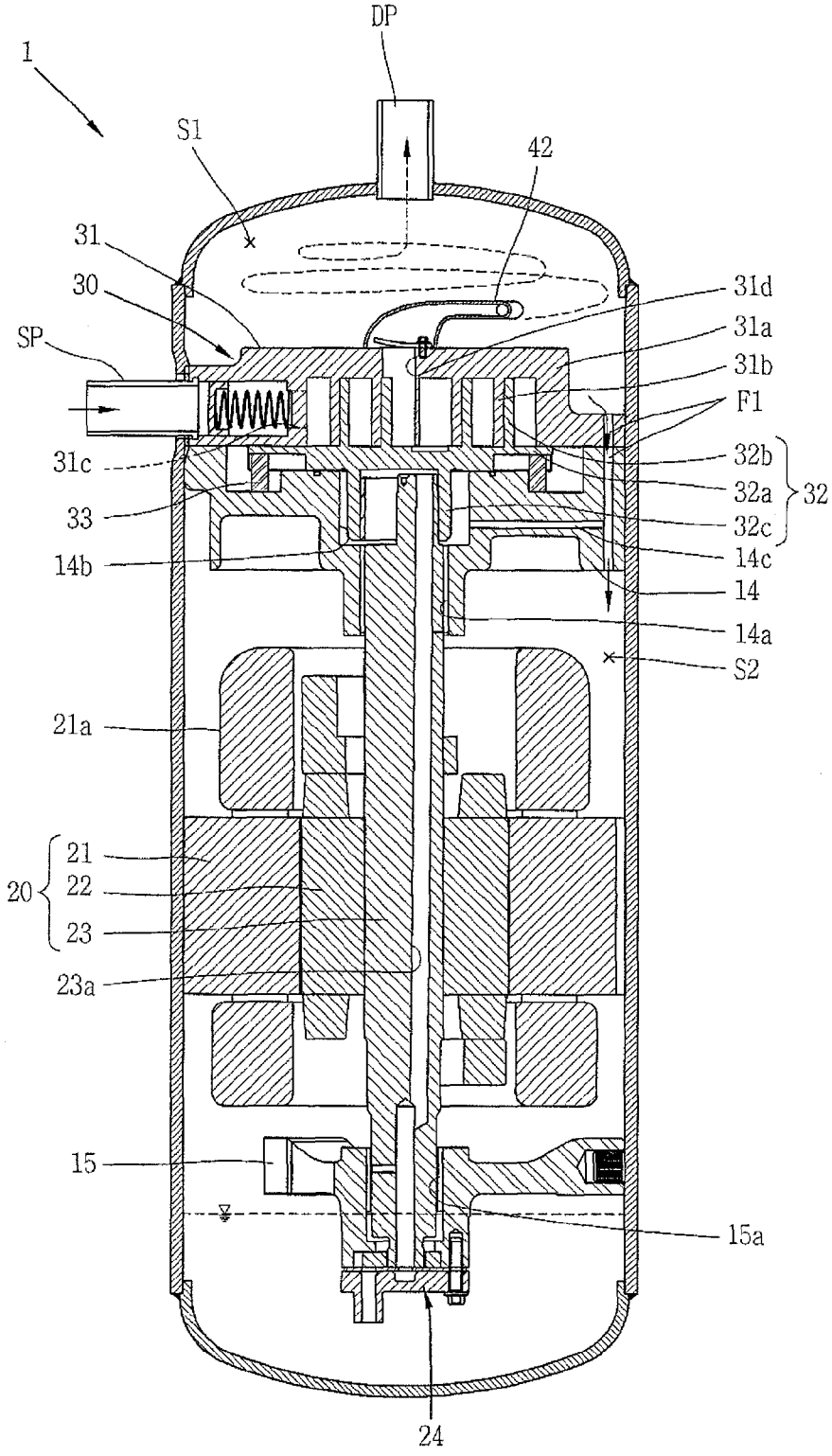
FIG. 11. is a longitudinal sectional view of a scroll compressor having an oil separating device according to still another embodiment.

FIG. 11 shows an oil separating device according to another embodiment. Like reference numerals have been used to designate like elements, and repetitive disclosure has been omitted. In the embodiment of FIG. 11, the guiding member and separating member have been formed as one piece. That is, the separating member 42 may extend from the discharge part 31*d* of the fixed scroll 31. The separating member 42 may be shaped such that it directs refrigerant into the upper space S1 such that the refrigerant circulates in a spiral within the upper space S1. In this way, oil may be separated from refrigerant due to centrifugal force and may drain from the upper space S1 through oil collecting passage F1 formed in the fixed scroll 31.

FIGS. 1 to 11 are applied to a high pressure type scroll compressor, an inner space of the casing of which is filled with a refrigerant at a discharge pressure. However, the embodiments may be also applied to a lower pressure type scroll compressor, the inner space of the casing of which is divided into a suction space and a discharge space by a high/low pressure separating plate or a fixed scroll. In such a configuration, an oil hole may be penetratingly formed in the high/low pressure separating plate or the fixed scroll, or oil separated from a refrigerant in the discharge space may be introduced into the suction space by an oil collecting pipe additionally installed to be connected to the discharge space and the suction space outside the casing. The low pressure type scroll compressor may have a similar construction to the high pressure type scroll compressor, and thus its details will be omitted.

Although an exemplary scroll compressor is presented herein, for ease of discussion, it is well understood that the oil separation device according to embodiments may be equally applied to other types of compressors, or another application in which this type of device is required and/or advantageous.

Figure 12:
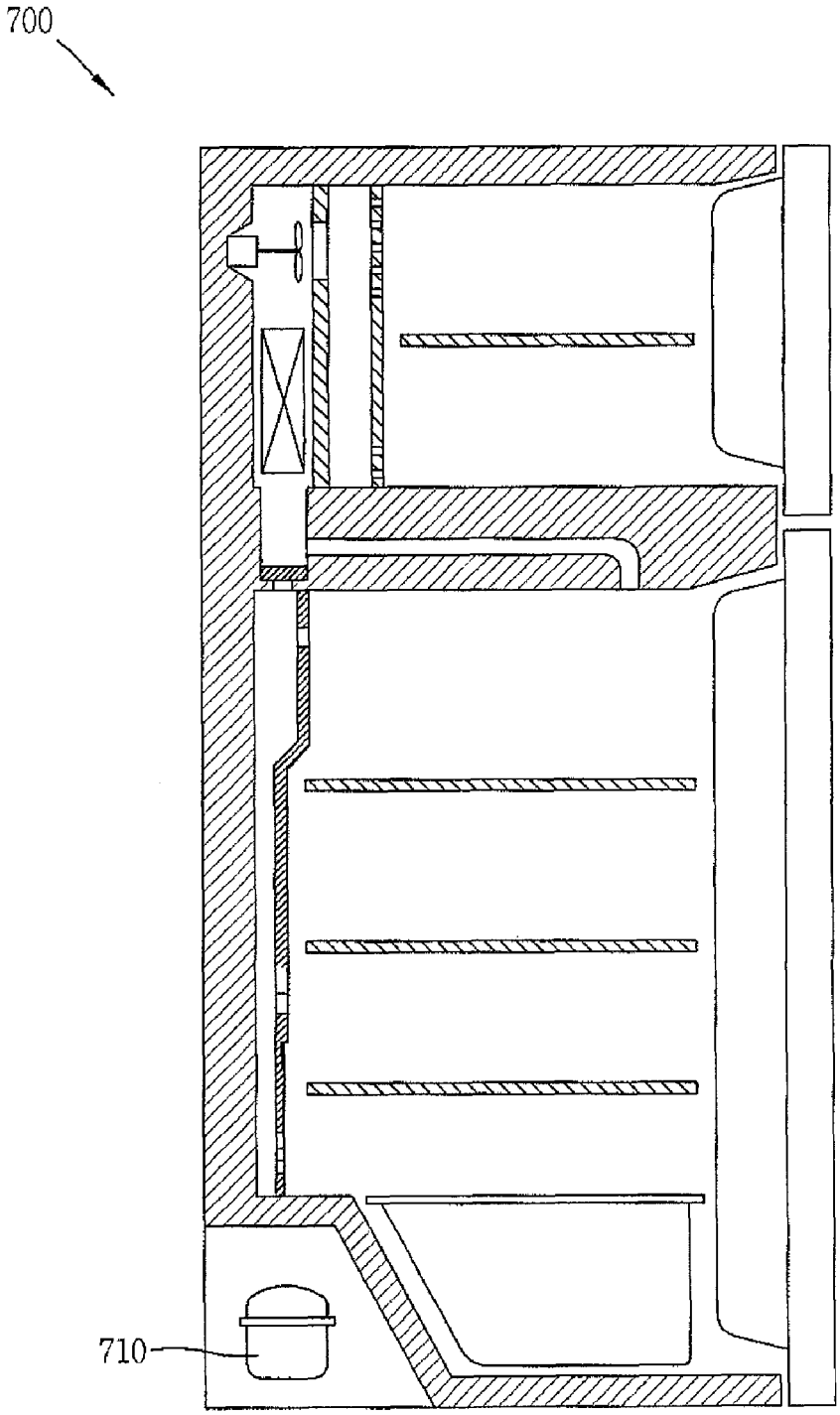
FIGS. 12-14 are exemplary installations of a compressor having an oil separating device according to embodiments disclosed herein.

More specifically, the compressor and oil separation device therefor according to embodiments disclosed herein has numerous applications in which compression of fluid is required, and in different types of compressors. Such applications may include, for example, air conditioning and refrigeration applications. One such exemplary application is shown in FIG. 12, in which a compressor 710 having an oil separation device according to embodiments disclosed herein is installed in a refrigerator/freezer 700. Installation and functionality of a compressor in a refrigerator is discussed in detail in U.S. Pat. Nos. 7,082,776, 6,955,064, 7,114,345, 7,055,338, and 6,772,601, the entirety of which are incorporated herein by reference.

Figure 13:
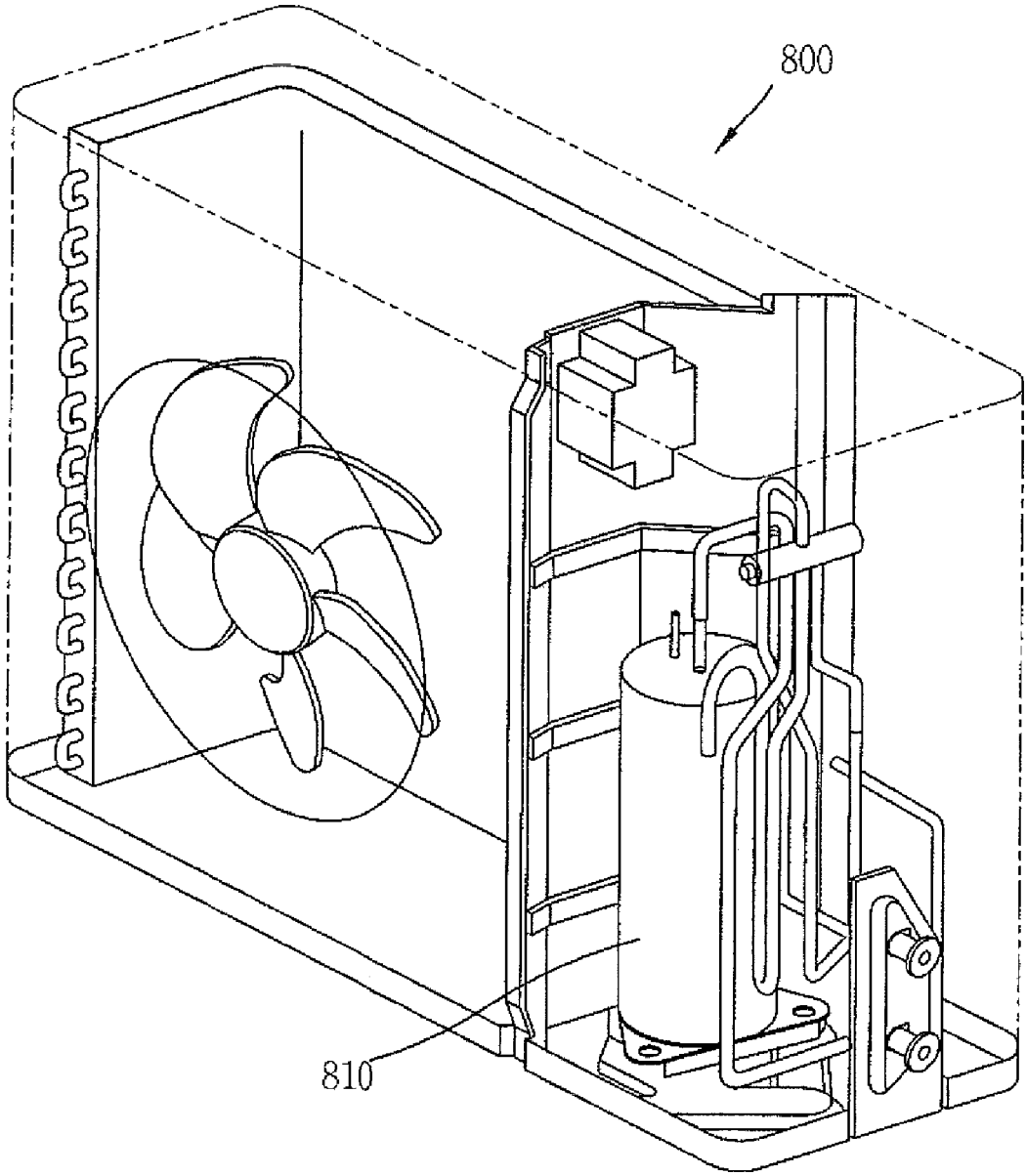

Another such exemplary application is shown in FIG. 13, in which a compressor 810 having an oil separation device according to embodiments disclosed herein is installed in an outdoor unit of an air conditioner 800. Installation and functionality of a compressor in a refrigerator is discussed in detail in U.S. Pat. Nos. 7,121,106, 6,868,681, 5,775,120, 6,374,492, 6,962,058, 6,951,628, and 5,947,373, the entirety of which are incorporated herein by reference.

Figure 14:
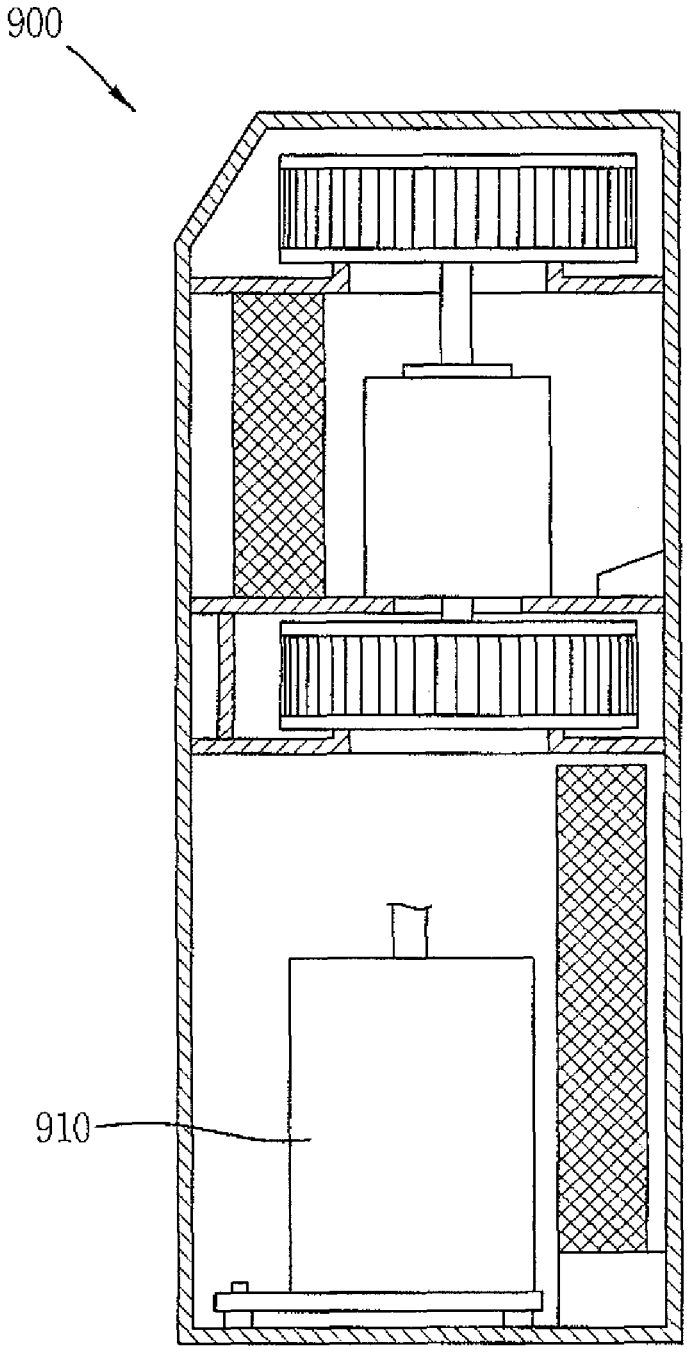

Another such exemplary application is shown in FIG. 14, in which a compressor 910 having an oil separation device according to embodiments disclosed herein is installed in a single, integrated air conditioning unit 900. Installation and functionality of a compressor in a refrigerator is discussed in detail in U.S. Pat. Nos. 7,032,404, 6,412,298, 7,036,331, 6,588,228, 6,182,460, and 5,775,123, the entirety of which are incorporated herein by reference.

As aforementioned, the scroll compressor according to the embodiments disclosed herein is provided with the oil separating device. Accordingly, a predetermined amount of oil is always maintained in the compressor without additionally installing the oil separating device in the refrigerating cycle system including the compressor. Accordingly, the refrigerating cycle system has simplified piping reducing fabrication costs, and the refrigerant has a constant pressure, preventing a function of the refrigerating cycle system from being lowered.

A compressor having an oil separating device according to embodiments is provided which is capable of always maintaining a predetermined amount of oil in the compressor without additionally providing an oil separating device along the a refrigerating cycle system. In accordance with embodiments broadly described herein, there is provided a scroll compressor that includes a casing having a hermetic inner space to which a discharge pipe is connected, a driving motor disposed at the inner space of the casing, a compression unit disposed at the inner space of the casing and forming a compression chamber as a plurality of scrolls are engaged to one another and an oil separating unit disposed at the inner space of the casing, for separating a refrigerant discharged from the compression chamber from oil by orbiting the refrigerant at the inner space of the casing.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing having a first inner space and a second inner space, and having a discharge pipe connected to the second inner space;

a frame fixed between the first inner space and the second inner space of the casing;

a driving motor fixedly-coupled to one side of the frame so as to be disposed at the first inner space of the casing, and fixed to an inner circumferential surface of the casing in a shrink-fit manner;

a fixed scroll fixedly-coupled to another side of the frame so as to be disposed at the second inner space of the casing, and having a discharge port provided in an axial direction through which a refrigerant compressed in a compression chamber is discharged;

an orbiting scroll installed between the frame and the fixed scroll, and configured to form a pair of compression chambers while performing an orbit motion, the compression chambers to consecutively move together with the fixed scroll;

a guide member installed at the second inner space of the casing with a guide space for accommodating the discharge port provided in the axial direction, and configured to guide a refrigerant discharged from the compression chamber through the discharge port to the first inner space of the casing; and a separation member configured to guide the refrigerant in the first inner space of the casing to the second inner space of the casing, and formed to be curved or rounded in a horizontal sectional direction with respect to the axial direction of the discharge pipe such that the refrigerant is separated from oil while orbiting in the second inner space of the casing, wherein one side of the guide member is coupled to an outer circumferential surface of the fixed scroll by sealing, and another side of the guide member is coupled to an inner circumferential surface of the casing by sealing.

2. The scroll compressor of claim 1, wherein a first passage for communicating the guide space of the guide member with the first inner space of the casing is formed inside the guide space of the guide member, a second passage for communicating the first inner space with the second inner space is formed outside the guide space of the guide member, and the separation member is coupled to the second passage so as to communicate with each other.

3. The scroll compressor of claim 2, wherein the separation member is provided with an inlet and an outlet, and the outlet is disposed at an upper side of the guide member.

4. The scroll compressor of claim 3, wherein an oil collecting through hole is penetratingly formed at the guide member so as to communicate the second inner space to the guide space.

5. The scroll compressor of claim 2, wherein the separation member is provided with an inlet and an outlet, and a sectional area of the inlet is different from a sectional area of the outlet.

6. The scroll compressor of claim 5, wherein the separation member is formed such that a sectional area of the outlet is smaller than a sectional area of the inlet.

7. The scroll compressor of claim 1, further comprising an oil recollection chamber located in the first inner space, wherein oil separated from the refrigerant within the second inner space is collected by gravity in the oil recollection chamber for reuse by the compressor.

8. The scroll compressor of claim 7, further comprising an oil collecting pipe in communication with the second inner space, wherein oil is separated from the refrigerant by gravity within the second inner space and drains therefrom through the oil collecting pipe to the oil recollection chamber for reuse.

9. The scroll compressor of claim 8, further comprising a capillary tube disposed on the oil collecting pipe.

10. A scroll compressor, comprising:

a casing having a first inner space and a second inner space, and having a discharge pipe connected to the second inner space;

a frame fixed between the first inner space and the second inner space of the casing;

a driving motor fixed to an inner circumferential surface of the casing in a forcible insertion manner so as to be disposed at the first inner space of the casing;

a fixed scroll fixedly-coupled to another side of the frame so as to be disposed at the second inner space of the casing, having a spiral-shaped fixing wrap for forming a compression chamber on one side surface thereof, having a discharge port penetratingly formed on another side surface thereof so as to discharge a compressed refrigerant from the compression chamber to the second inner space of the casing;

an orbiting scroll installed between the frame and the fixed scroll, having a spiral-shaped orbiting wrap engaged with the fixing wrap of the fixed scroll on one side surface thereof, and configured to form a pair of compression chambers together with the fixed scroll while performing an orbit motion as another side surface thereof is eccentrically coupled to a crank shaft of the driving motor, the two compression chambers to consecutively move together with the fixed scroll;

a check valve installed at an end of the discharge port of the fixed scroll;

a guide member having a guide space for accommodating the check valve, having one side fixed to the fixed scroll and another side fixed to an inner circumferential surface of the casing, and configured to guide a refrigerant discharged from the compression chamber through the discharge port to the driving motor; and a separation member configured to guide the refrigerant having been guided to the driving motor by the guide member to the second inner snare of the casing, and formed in a spiral curve such that the refrigerant introduced into the second inner space is separated from oil by a centrifugal force, wherein one side of the guide member is coupled to an outer circumferential surface of the fixed scroll by sealing, and another side of the guide member is coupled to an inner circumferential surface of the casing by sealing.

11. The scroll compressor of claim 10, wherein a first passage for communicating the guide space of the guide member with the first inner space of the casing is formed at the frame and the fixed scroll inside the guide space of the guide member, a second passage for communicating the first inner space with the second inner space is formed at the frame and the fixed scroll outside the guide space of the guide member, and the separation member is coupled to the second passage so as to communicate with each other.

12. The scroll compressor of claim 11, wherein the separation member is provided with an inlet and an outlet, and the outlet thereof is disposed at an upper side of the guide member.

13. The scroll compressor of claim 12, wherein an oil collecting through hole is penetratingly formed at the guide member so as to communicate the second inner space to the guide space.

14. The scroll compressor of claim 11, wherein the separation member is provided with an inlet and an outlet, and a sectional area of the inlet is different from a sectional are of the outlet.

15. The scroll compressor of claim 14, wherein the separation member is formed such that a sectional area of the outlet is smaller than a sectional area of the inlet.

16. The scroll compressor of claim 10, further comprising an oil recollection chamber located in the first inner space, wherein oil separated from the refrigerant within the second inner space is collected by gravity in the oil recollection chamber for reuse by the compressor.

17. The scroll compressor of claim 16, further comprising an oil collecting pipe in communication with the second inner space, wherein oil is separated from the refrigerant by gravity within the second inner space and drains therefrom through the oil collecting pipe to the oil recollection chamber for reuse.

18. The scroll compressor of claim 17, further comprising a capillary tube disposed on the oil collecting pipe.

* * * * *